US005104289A

United States Patent [19]

Moreci

[11] Patent Number: 5,104,289

[45] Date of Patent: Apr. 14, 1992

[54] TURBINE HAVING SUPPORT ARRANGEMENT FOR MINIMIZING HUMPING

[75] Inventor: John A. Moreci, Lake Mary, Fla.

[73] Assignee: Westinghouse Electric Corp., Pittsburgh, Pa.

[21] Appl. No.: 603,077

[22] Filed: Oct. 25, 1990

[51] Int. Cl.[5] ..... F01D 25/28

[52] U.S. Cl. ..... 415/213.1; 415/177; 248/674

[58] Field of Search ..... 415/213.1, 214.1, 201, 415/177; 248/637, 674

[56] References Cited

U.S. PATENT DOCUMENTS

| | | | |
|---|---|---|---|
| 952,318 | 3/1910 | Eyermann | 415/213.1 |
| 1,678,968 | 7/1928 | Allen | 415/213.1 |
| 1,828,407 | 10/1931 | Guy | 248/637 |
| 3,197,161 | 7/1965 | Christofferson | 248/637 |
| 3,310,940 | 3/1967 | Oetliker | 415/177 |
| 3,369,783 | 2/1968 | Teating | 248/637 |
| 3,752,427 | 8/1973 | Bellati | 415/213.1 |
| 3,860,359 | 1/1975 | De Feo | 415/213.1 |
| 3,892,500 | 7/1975 | Miller et al. | 415/214.1 |
| 4,204,804 | 5/1980 | Woodger | 415/213.1 |
| 4,456,426 | 6/1984 | Bellati | 415/213.1 |

*Primary Examiner*—John T. Kwon

[57] ABSTRACT

Apparatus is disclosed for reducing humping in steam turbines, where the steam turbine includes a rotor assembly, rotatably mounted to a foundation, a stator assembly, positioned about said rotor assembly, an outer cylinder, to which the stator assembly is attached, which outer cylinder being divided into a cover half and a base half. The apparatus for reducing humping includes a plurality of support towers attached to the foundation and a plurality of support paws attached to the base half, wherein each support paw is mounted on a support tower. Each of said support paws is shown to include first and second sidewalls, each attached along one end to the base half and a top wall positioned between the side walls. The top wall and the first and second side walls define a cavity, whereby a portion of the support tower fits within the cavity. The division between the cover and base halves defines a joint. The first and second sidewalls are formed such that they extend beyond the joint. The top wall defines a lower surface. Such lower surface is preferably coplanar with the joint.

14 Claims, 4 Drawing Sheets

TURBINE HAVING SUPPORT ARRANGEMENT FOR MINIMIZING HUMPING

FIELD OF THE INVENTION

The present invention relates to the field of turbines, and more particularly, to the support structure of high pressure and intermediate pressure steam turbines for maximizing efficiency and reliability.

BACKGROUND OF THE INVENTION

The provision of steam to a turbine is typically accompanied by the transfer of heat between the steam and those components of the turbine coming into contact with the steam. Since most turbine components are formed from highly thermally conductive material, heat transfer can cause thermal distortion in various components due primarily to nonuniform heat transfer. Such deformation can be of two types: elastic which is recoverable upon release of the transferred heat, and plastic which is permanent.

One form of elastic thermal distortion can occur during shutdown transients in high pressure (HP) steam turbines, intermediate pressure (IP) steam turbines and combination HP-IP steam turbines. In particular, during shutdown transients seal rubs can occur in those turbines. Those familiar with HP, IP and HP-IP steam turbines will recognize that during shutdown transients relatively large temperature differentials can develop between the cover and base components of the outer cylinder. These temperature differentials can reach approximately 120° F. Typically, the cover is hotter than the base causing the outer cylinder to hump, i.e. rise in the center and pivot at the support paws. Since internal stationary parts, i.e. inner cylinders and rings, are attached to the outer cylinder, they too move in relation to the outer cylinder. Since the rotor is supported independently of the outer cylinder it retains its normal configuration. As a result, seal clearances between rotating and stationary parts close in the base and open in the cover. This phenomenon is referred to as turbine humping. If the humping is severe enough undesirable rubbing will occur.

In the past, one approach to prevent turbine humping has been the use of heating blankets in an effort to reduce the temperature differential. Unfortunately such a solution is very costly.

In the development of the present invention, an investigation was made of the turbine humping phenomenon. It was discovered for certain types of HP-IP turbines that 33 to 50 percent of the humping was attributable to the support paws. Support paws are extensions or projections generally integrally formed at the ends of the outer cylinder for supporting the outer cylinder on the foundation structure. When the turbine humps, the support paws act as pivot points. The longer the paw, the greater the pivot action. It was also discovered that the support paws had a thermal gradient of approximately 150° F. along its length. This thermal gradient contributes a second order effect to overall humping.

Some presently available steam turbines incorporate cover support paws which project straight off the cover portion of the outer cylinder and which are generally shorter in length. Unfortunately, cover support paws suffer from two problems. First, assembly and disassembly of turbines using such supports is complicated and thus more costly. Second, the horizontal joint bolting must support the weight load of the turbine as well as normally supported loads.

Another form of elastic thermal distortion that can occur in steam turbines results from thermal expansion and contraction of the outer cylinder and is referred to as thermal displacement. During thermal displacement in steam turbines where the support plane and the horizontal joint plane are separated a distance, portions of the stator assembly are displaced in relation to the rotor assembly effecting turbine operating efficiency and which can result in rubbing.

Consequently, a need still exists for a steam turbine which is free from humping without resorting to heating blankets, which is free from the drawbacks of cover support paws and in which thermal displacement is minimized.

SUMMARY OF THE INVENTION

It is an object of the invention to provide a steam turbine in which humping is minimized.

It is another object of the invention to provide a steam turbine in which efficiency and alignment are maintained relatively stable during shutdown transients.

It is a further object of the invention to prevent humping by providing a turbine having a plurality of support paws which each define a cavity for reception of a support tower.

These and other objects are achieved in a steam turbine having structure for reducing humping, where the steam turbine includes a rotor assembly rotatably mounted to a foundation, a stator assembly positioned about said rotor assembly and an outer cylinder to which the stator assembly is attached, which outer cylinder is divided into a cover half and a base half. The apparatus for reducing humping includes a plurality of support towers attached to the foundation and a plurality of support paws attached to the base half, wherein each support paw is mounted on a support tower. Each of said support paws includes first and second sidewalls and is attached along one end to the base half and has a top wall positioned between the side walls. The top wall and the first and second side walls define a cavity, whereby a portion of the support tower fits within the cavity. The division between the cover and base halves defines a joint. The first and second sidewalls are formed such that they extend beyond the joint so that the lower surface of the top wall is substantially coplanar with the joint.

Multiple advantages are achieved by incorporating support paws of the preferred type, i.e., of minimal axial length connected to the base half and supporting the base half on a plane which is substantially co-planar with the joint. Turbine humping is reduced to a minimum. Moreover, the complexities of turbine disassembly are minimized because the cover half can be removed without providing any additional support for the base half. Still further, misalignment caused by thermal displacement has also been minimized.

These and other objects and advantages of the invention will become more apparent from the following detailed description when taken in conjunction with the following drawings.

DETAILED DESCRIPTION OF THE PREFERRED EMBODIMENT

Figure 1:
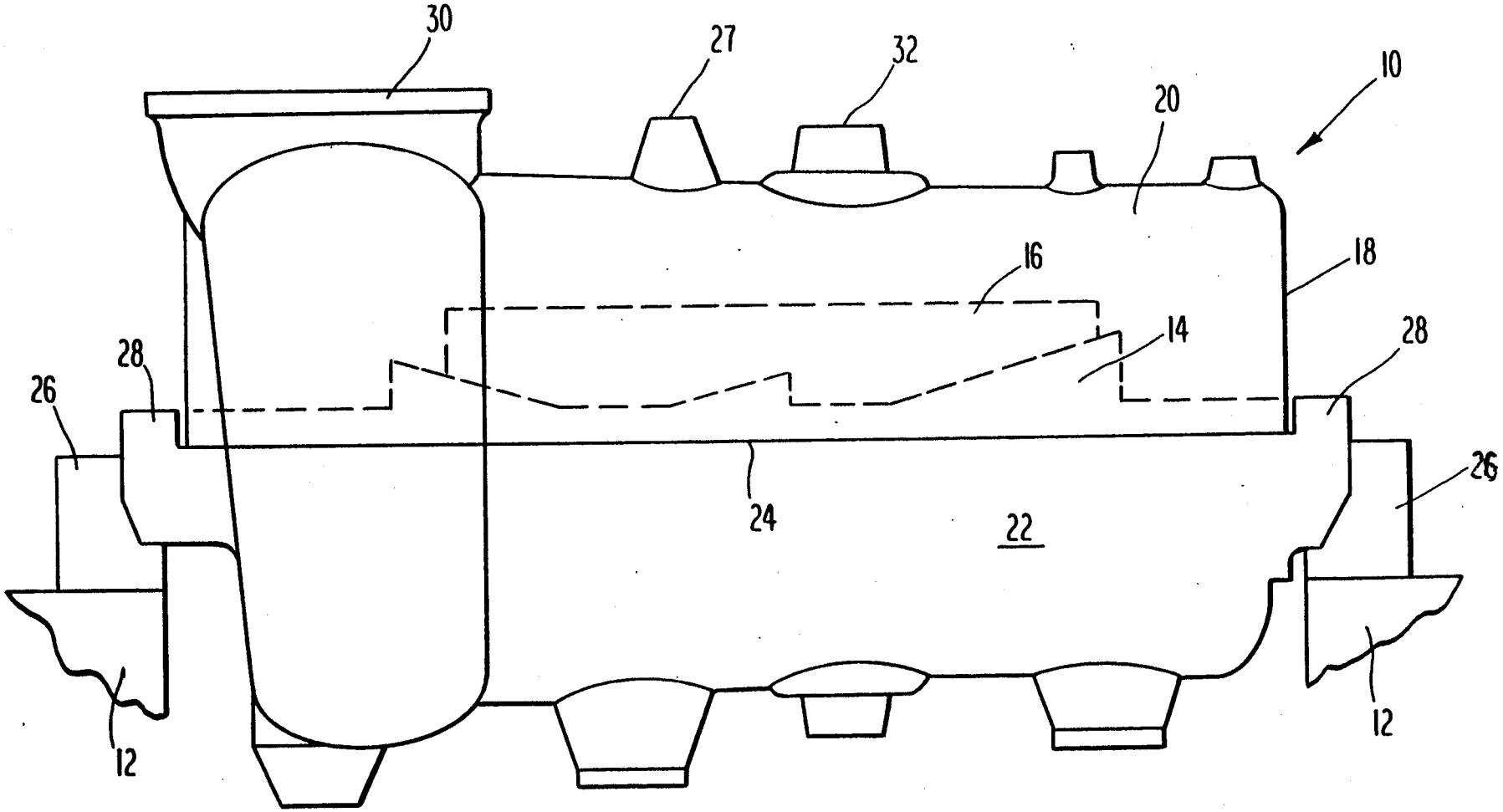
FIG. 1 is a diagrammatic view of an HP-IP steam turbine in accordance with the present invention.

A new and novel steam turbine having apparatus for the minimization and/or elimination of humping is diagrammatically shown in FIG. 1. Steam turbine 10 is mounted to a foundation 12 and is shown to include a rotor assembly 14. Rotor assembly 14 is rotatably mounted to foundation 12 by any known methods and devices and the rotor assembly can be of any known construction utilized in an HP-IP steam turbine. A stator assembly 16 is positioned about rotor assembly 14 and in cooperative relationship therewith. In other words, as steam passes between rotor assembly 14 and stator assembly 16, rotation of rotor assembly 14 results. It would be appreciated by those familiar with steam turbines that steam passing between rotor assembly .14 and stator assembly 16 is directed by various blades (not shown) fixed to the stator assembly onto blades fixed to the rotor assembly. An outer cylinder 18 is positioned about stator assembly 16, and stator assembly 16 is attached thereto by any known method or device. Outer cylinder 18 is divided into a cover half 20 and a base half 22. The division between cover half 20 and base half 22 defines a horizontal joint 24.

The plurality of support towers 26 are attached to foundation 12. Attachment of support towers 26 to foundation 12 can be by any known method or device. The plurality of support paws 28 (only two are depicted) are attached to base half 22. Each support paw 28 is mounted on a support tower 26. Steam turbine 10 also includes a number of inlets and outlets which permit the division and exhaust of steam. Inlet 27 is a high pressure steam inlet. Outlet 30 is an intermediate pressure exhaust outlet and inlet 32 is an intermediate pressure reheated steam inlet.

Figure 2:
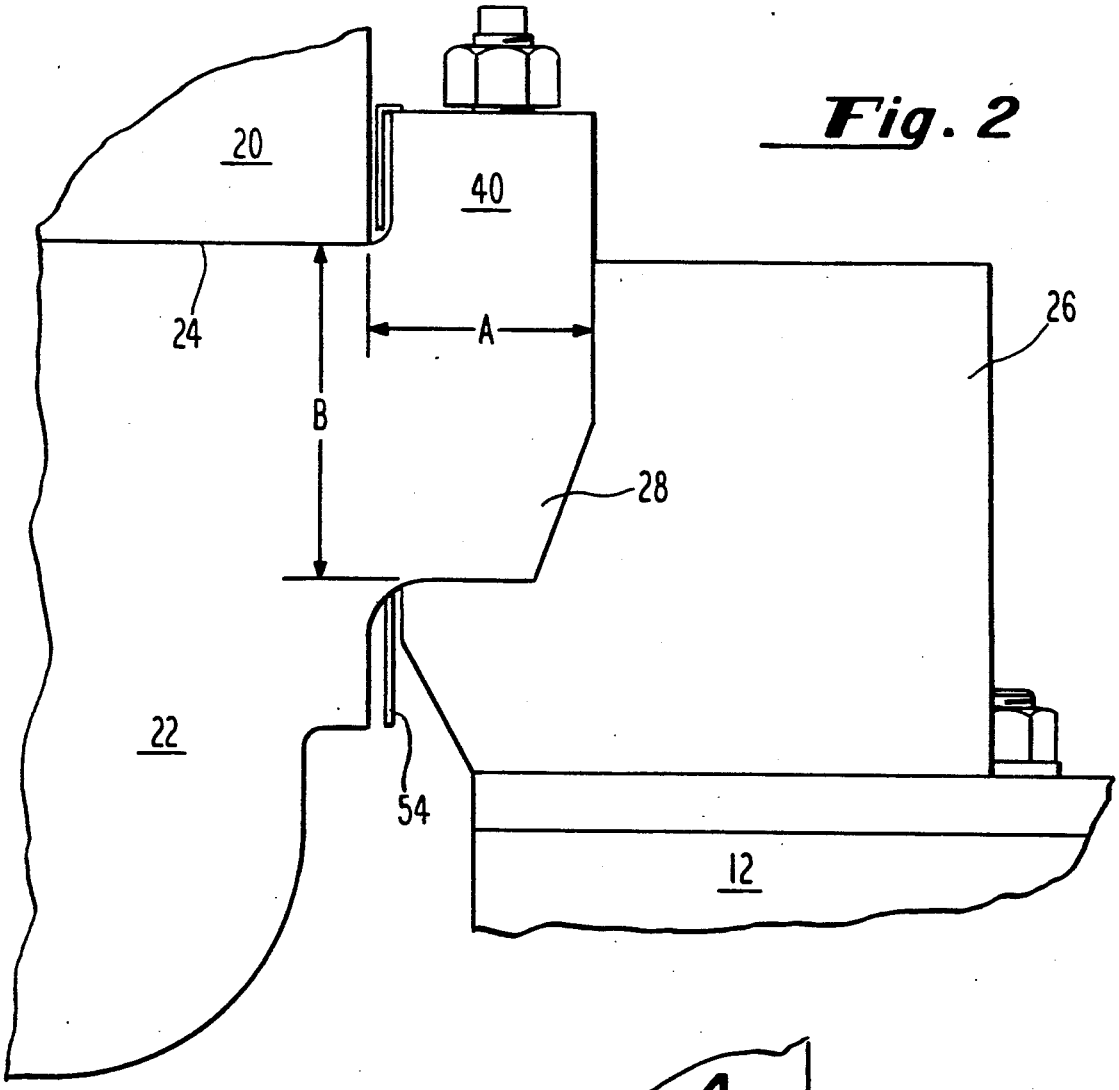
FIG. 2 is an enlarged view of one of the support paws/ support tower assemblies constructed in accordance with the present invention and positioned at the governor end of the turbine.
Figure 3:
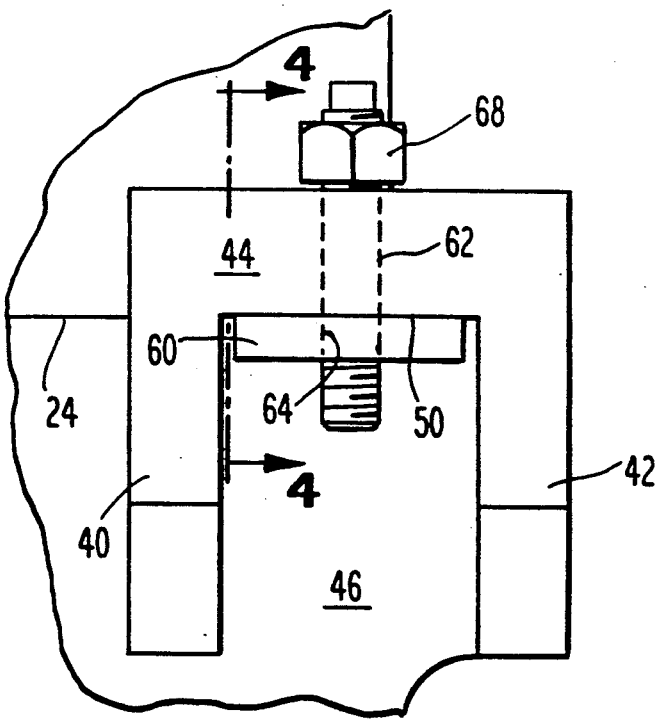
FIG. 3 is an end view of the support paw depicted in FIG. 2, wherein the support tower has not been shown.
Figure 4:
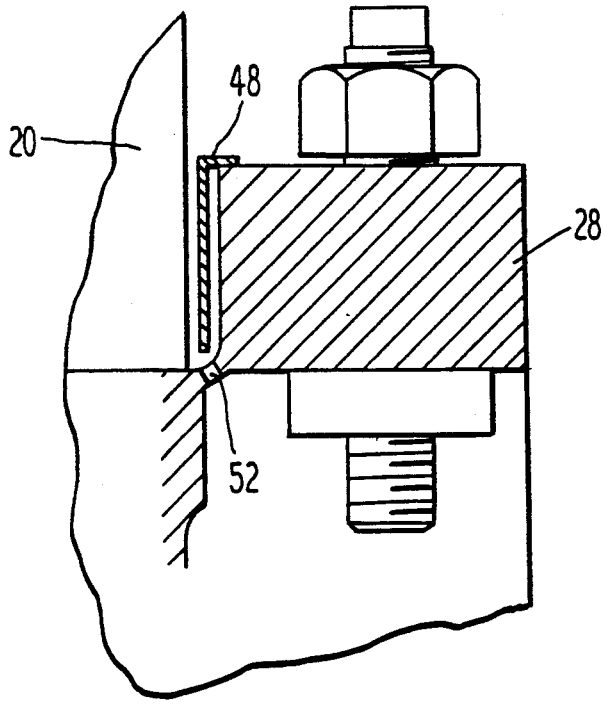
FIG. 4 is a section view taken along the line 4—4 in FIG. 3.

Referring now to FIGS. 2 and 3, the support paws 28 are shown to include side walls 40 and 42, which side walls are attached along one end to base half 22. In the preferred embodiment, the side walls are integrally formed on base half 22. A top wall 44 is positioned between side walls 40 and 42, wherein the side walls and top wall 44 define a cavity 46. As will be appreciated from viewing FIG. 2, a portion of support tower 26 fits within cavity 46. It will be noted that in operation a gap or clearance exists between side walls 40 and 42 and support tower 26. Referring to FIG. 4, support paw 40 is shown to have an insulating shield 48 positioned between support paw 28 and cover half 20. Insulating shield 48 obstructs the transfer of heat between support paw 28 and cover half 20. As will be appreciated from FIGS. 2, 3 and 4, side walls 40 and 42 extend out from base half 22 a short distance. The direction of the extension of side walls 40 and 42 is generally parallel to the axis of rotation of rotor assembly 14. The distance which side walls 40 and 42 extend away from base half 22 is less than the distance along which side walls 40 and 42 attach to base half 22. In more practical terms, in FIG. 2 there is shown a distance A which represents the extension of side walls 40 and 42 from base half 22. There is also shown a length B, which is representative of the attachment length of walls 40 and 42 to base half 22. Distance A is preferably less than distance B. As will be seen in FIGS. 2 and 3, side walls 40 and 42 extend beyond horizontal joint 24. As specifically shown in FIG. 3, top wall 44 defines a lower surface 50 which lower surface is preferably co-planar with joint 24. As shown in FIG. 4, support paw 28 has a slot 52 which permits the passage of air from outside the support paw 28 to within cavity 46.

Figure 5:
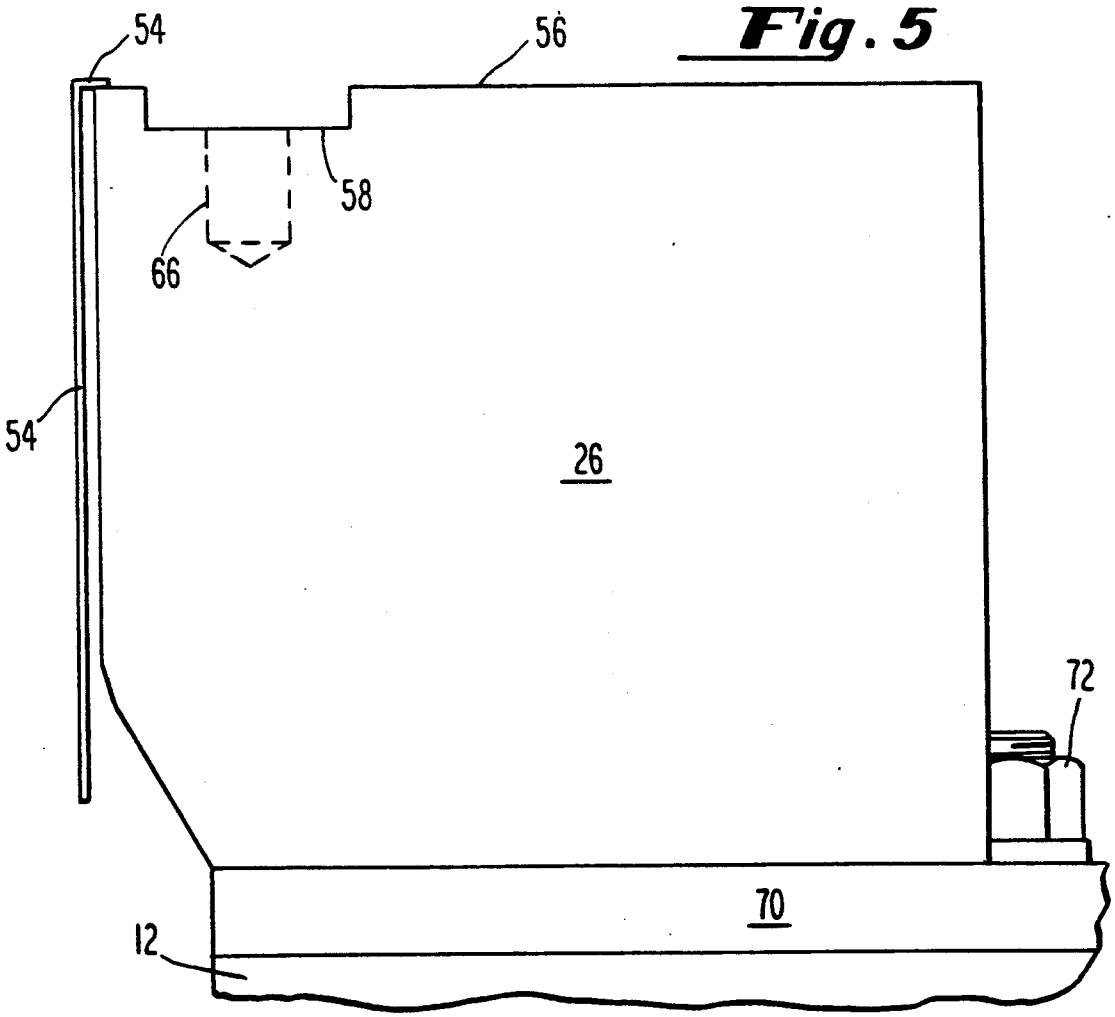
FIG. 5 is an enlarged side view of the support tower depicted in FIG. 2.

Referring now to FIG. 5, a support tower 26 is shown in an isolated view. Insulating shield 54 is shown to be attached to the top surface 56 of support tower 26 and extends down along one end of support tower 26. As will be appreciated, when support tower 26 is positioned within cavity 46, insulating shield 54 will be positioned between support tower 26 and base half 22. Insulating shield 54 obstructs the transfer of heat between base half 22 and support tower 26.

The top surface 56 has a slot 58 formed therein. Referring also to FIG. 3, support paw 28 is shown to further include a connector 60 which abuts lower surface 50. Connector 60 is designed to fit within slot 58. As will be appreciated in relation to FIGS. 3 and 5, top wall 44 has a bore 62 passing therethrough. Connector 60 has a bore 64 passing therethrough. And support tower 26 has a threaded bore 66 formed in slot 58. A bolt 68 passes through bores 62 and 64 and threadingly engages threaded bore 66. It will be noted that a clearance is preferably provided between bolt 68 and bores 62 and 64 to allow for movement caused by thermal expansion of base half 22 and turbine 10. For this same reason it is also preferred to have a clearance between bolt 68 and top wall 44.

Support tower 26 is shown to be attached by any known means to a support pad 70, which support pad is slidably attached to foundation 12 by any suitable means such as the use of bolt 72. In the preferred embodiment, bolt 72 is not tightened down into contact with pad 70, but rather, is tightened to a point a short distance from 70. Such distance or clearance, together with the slot shown in FIG. 6, allows pad 70 and support tower 26 to move or slide in relation to foundation 12 during thermal expansion and contraction of base half 22. In this fashion, base half 22 and thus turbine 10 is attached to foundation 12.

It is noted that those familiar with steam turbines will recognize that a center beam normally associated with turbines of the type depicted herein has not been shown in the figures. In operation, such a center beam would also push against pad 70 during periods of thermal expansion, causing pad 70 to slide in relation to foundation 12.

Figure 6:
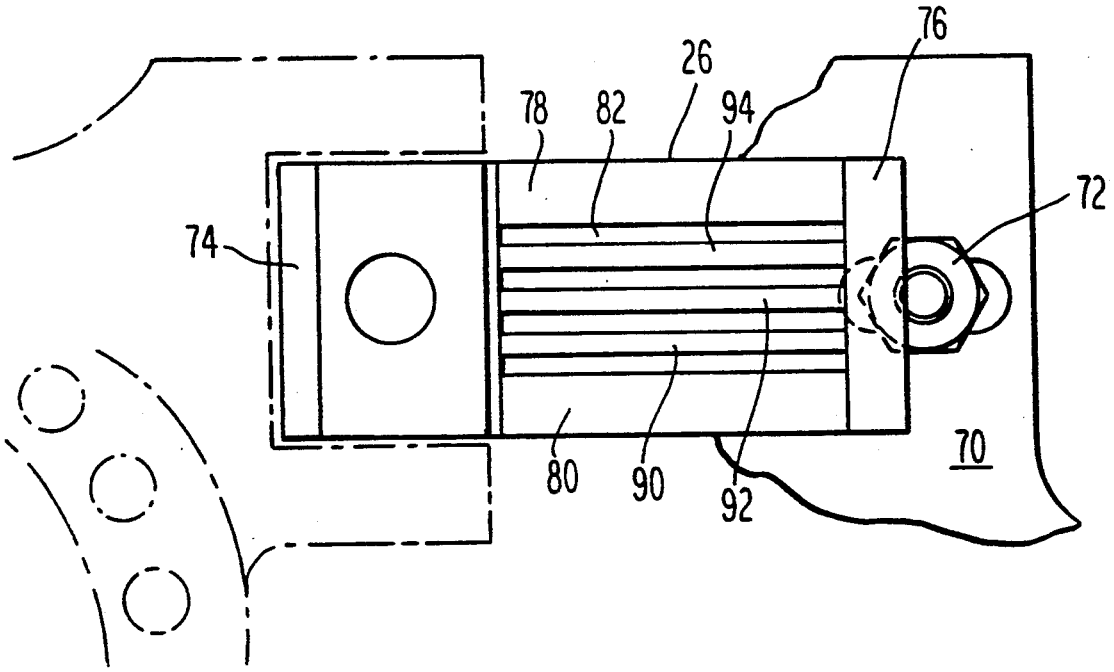
FIG. 6 is a top view of the support tower depicted in FIG. 5.
Figure 7:
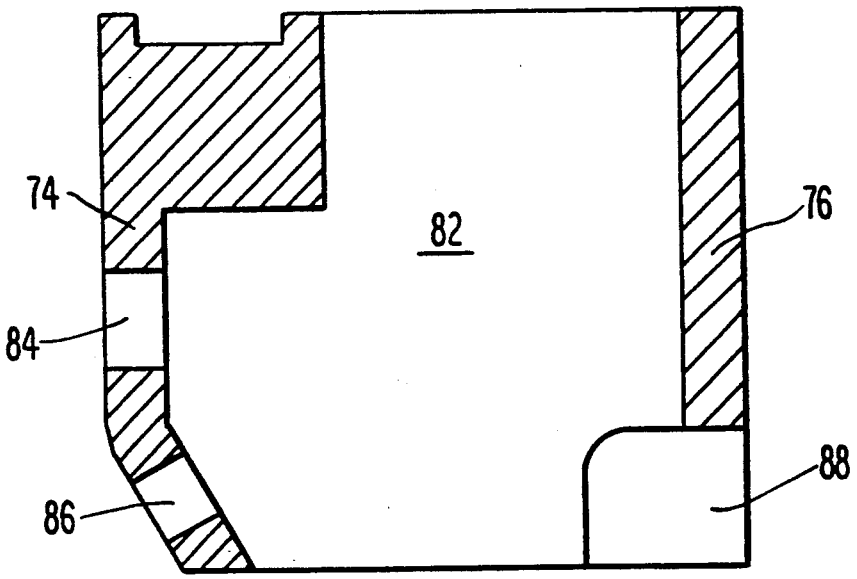
FIG. 7 is a section view of FIG. 6.

Referring now to FIG. 6, support tower 26 is shown to include first and second end walls 74 and 76 and side walls 78 and 80. The end walls and side walls of support tower 26 define a cavity 82. As shown in FIG. 7, end walls 74 and 76 have vent passages 84, 86 and 88 formed therethrough which permit air to pass from outside support tower 26 into cavity 82. As shown in FIG. 6, a plurality of thin plates 90, 92 and 94 are positioned within cavity 82 and are sized to contact end walls 74 and 76. Thin plates 90, 92 and 94 increase the heat dissipation surface area of support tower 26.

It will be noted that the insulating shields 48 and 54, vent 52 and passages 84, 86 and 88 serve to keep the temperature of the support tower to an acceptable level, thus controlling the thermal expansion of support tower 26. The minimization of thermal expansion of support tower 26 is important not only because a portion of the support tower fits within cavity 46, but also, because as support tower 26 expands it can lift, i.e., provide vertical forces, to the turbine which can effect the clearances between stator assembly 16 and rotor assembly 14. If expansion of support tower 26 were not controlled, impermissible expansion could occur resulting in undesirable rubbing.

The above described support paw is believed to be particularly advantageous because it directly addresses the humping problem without the necessity of utilizing heating blankets or other operational restrictions. For example, the support paw provides for minimal extension from base half 22, but yet avoids the drawbacks of prior cover paws, thus avoiding assembly complexities. In addition, since support is occurring in a plane which is substantially co-planar with horizontal joint 24, thermal displacement has been minimized. Radial expansion will occur away from the horizontal joint, rather than between the horizontal joint plane and the support plane, thus avoiding the displacement of portions of the stator assembly relative to the rotor assembly.

While the invention has been described and illustrated with reference to specific embodiments, those skilled in the art will recognize that modification and variations may be made without departing from the principles of the invention as described herein above and set forth in the following claims.

I claim:

1. In a steam turbine wherein heat is transferred between a flow of steam provided to said turbine and the structure of said steam turbine during operation, wherein said turbine comprises an outer cylinder, which outer cylinder is divided into a base half and a cover half, apparatus for preventing humping during shutdown transients comprising:

a plurality of support towers attached to a foundation; and a plurality of support paws attached to said base half, wherein when said turbine is attached to said foundation each support paw contacts a support tower, each of said support paws comprising:

first and second sidewalls, each attached along one end to said base half; and a top wall positioned between said side walls, said top wall and said first and second side walls defining a cavity, wherein a portion of said support tower fits within said cavity and wherein each of said support paws has a slot formed therethrough permitting the passage of air from outside said support paw into said cavity.

2. A steam turbine, mounted to a foundation, said turbine comprising:

a rotor assembly, rotatably mounted to said foundation;

a stator assembly, positioned about said rotor assembly and in cooperative relationship therewith, wherein steam passing between said rotor assembly and said stator assembly results in rotation of said rotor assembly;

an outer cylinder, positioned about said stator assembly and to which said stator assembly is attached, said outer cylinder being divided into a cover half and a base half, wherein the division between said cover and base halves defines a joint;

a plurality of supports towers attached to said foundation; and a plurality of support paws attached to said base half, wherein each support paw is mounted on a support tower, each of said support paws comprising:

first and second sidewalls, each attached along one end to said base half; and a top wall positioned between said side walls, said top wall and said first and second side walls defining a cavity, wherein a portion of said support tower fits within said cavity and wherein each of said support paws has a slot formed therethrough permitting the passage of air from outside said support paw into said cavity.

3. The turbine of claim 2, wherein said support paw further comprises an insulator for obstructing the transfer of heat between said support tower and said base half.

4. The turbine of claim 3, wherein said insulator is positioned in said cavity.

5. The turbine of claim 2, wherein said support paw further comprises an insulator for obstructing the transfer of heat between said support paw and said cover half.

6. The turbine of claim 2, wherein said rotor assembly defines an axis of rotation, wherein said first and second side walls extend out from said base half a first distance and wherein the attachment of said first and second sidewalls to said base half extends for a second distance, further comprising said second distance being longer than said first distance.

7. The turbine of claim 2, wherein said first and second sidewalls extend beyond said horizontal joint.

8. The turbine of claim 7, wherein said top wall defines a lower surface and wherein said lower surface is coplanar with said joint.

9. The turbine of claim 2, wherein said support tower defines a top surface, said support tower having a first slot formed in said top surface, wherein said top wall defines a lower surface, said support paw further comprising a connector positioned to fit within said first slot.

10. The turbine of claim 9, wherein said top wall further has a first bore extending through said top wall into said first slot, wherein said connector has a second bore extending therethrough, and wherein said support tower has a threaded bore formed in said first slot, further comprising a bolt positioned in said first and second bores and threadingly engaging said threaded bore.

11. The turbine of claim 2, wherein said support paw is integrally formed with said base half.

12. The turbine of claim 2, wherein said support tower comprises, first and second end walls and third and fourth sidewalls, the endwalls and sidewalls defining a second cavity.

13. The turbine of claim 12, wherein said first and second endwalls have vent passages formed therethrough permitting air to pass from outside said support tower into said second cavity.

14. The turbine of claim 12, wherein said support tower further comprises a plurality of fin plates, positioned within said second cavity, and contacting said end walls for increasing the heat dissipation surface area of said support tower.

* * * * *